US010119451B2

(12) United States Patent
Seeger

(10) Patent No.: US 10,119,451 B2
(45) Date of Patent: Nov. 6, 2018

(54) INTERNAL COMBUSTION ENGINE COOLING

(71) Applicant: GM GLOBAL TECHNOLOGY OPERATIONS LLC, Detroit, MI (US)

(72) Inventor: Peter Seeger, Ruesselsheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 99 days.

(21) Appl. No.: 15/216,252

(22) Filed: Jul. 21, 2016

(65) Prior Publication Data

US 2017/0022880 A1 Jan. 26, 2017

(30) Foreign Application Priority Data

Jul. 22, 2015 (DE) ..... 10 2015 009 501

(51) Int. Cl.
*F01P 3/02* (2006.01)
*F01P 7/14* (2006.01)

(52) U.S. Cl.
CPC ..... *F01P 3/02* (2013.01); *F01P 2007/146* (2013.01)

(58) Field of Classification Search
CPC ..... F01P 3/02
USPC ..... 123/41.08
See application file for complete search history.

(56) References Cited

U.S. PATENT DOCUMENTS 4,729,347 A * 3/1988 Schmitz ..... F01P 3/02 123/41.74
5,435,275 A 7/1995 Bergsten et al.
5,453,573 A 9/1995 Callas
6,164,248 A 12/2000 Lehmann
6,446,586 B2 9/2002 Fukamachi
6,539,899 B1 * 4/2003 Piccirilli ..... F01P 7/167 123/41.08
7,430,994 B2 10/2008 Petutsching et al.
7,721,683 B2 5/2010 Lutz et al.
8,757,110 B2 6/2014 Triebe et al.
9,212,620 B2 12/2015 Berkemeier et al.
2005/0011181 A1 * 1/2005 Tawa ..... F01N 13/008 60/276

(Continued)

FOREIGN PATENT DOCUMENTS

DE 102012001199 A1 7/2013
DE 202015100577 U1 2/2015

(Continued)

OTHER PUBLICATIONS

German Patent Office, German Search Report for German Application No. 102015009501.3, dated Mar. 22, 2016.

*Primary Examiner* — Joseph Dallo
*Assistant Examiner* — Yi-Kai Wang
(74) *Attorney, Agent, or Firm* — Lorenz & Kopf, LLP

(57) ABSTRACT

An internal combustion engine for a motor vehicle drive includes a housing having a cylinder head water jacket, an exhaust water jacket and a combustion chamber water jacket. A valve is operable for adjusting a flow through a multi-channel coolant inlet. In particular, the valve provides continuous adjustment of a cross section, through which a fluid can flow of a multi-channel exhaust coolant outlet for admitting a flow to the exhaust water jacket and cross-section, through which a fluid can flow of a multi-channel combustion chamber coolant outlet for admitting a flow to the combustion chamber water jacket.

20 Claims, 5 Drawing Sheets

(56) References Cited

U.S. PATENT DOCUMENTS

| | | | | |
|---|---|---|---|---|
| 2007/0227473 | A1* | 10/2007 | Tsubouchi | F01P 3/202 123/41.31 |
| 2010/0282190 | A1* | 11/2010 | Stoermer | F16K 11/0856 123/41.08 |
| 2013/0206085 | A1* | 8/2013 | Adam | F01N 3/046 123/41.72 |
| 2014/0026829 | A1 | 1/2014 | Tobergte et al. | |
| 2014/0209046 | A1* | 7/2014 | Steiner | F01P 5/10 123/41.31 |

FOREIGN PATENT DOCUMENTS

| | | | |
|---|---|---|---|
| DE | 102014200668 | A1 | 7/2015 |
| DE | 102014201167 | A1 | 7/2015 |
| EP | 1375857 | A1 | 1/2004 |
| WO | 2008029058 | A2 | 3/2008 |

* cited by examiner 42, 46
20
47
49
41
30
45

47
42
46
43
30
20
48
41
48
45

47
20
43, 46
30
48
41
45

INTERNAL COMBUSTION ENGINE COOLING

CROSS-REFERENCE TO RELATED APPLICATION

This application claims priority to German Patent Application No. 102015009501.3, filed Jul. 22, 2015, which is incorporated herein by reference in its entirety.

TECHNICAL FIELD

The present disclosure pertains to an internal combustion engine for a motor vehicle drive, with a cylinder head water jacket, a combustion chamber water jacket and an exhaust water jacket, a vehicle with the internal combustion engine as well as a method of cooling the internal combustion engine.

BACKGROUND

From US 2014/0026829 A1 a system is known for the liquid cooling of an internal combustion engine with a cylinder head with an integrated water jacket, and a cylinder block with an integrated water jacket. A valve with a rotary slide which in a first operating position separates a first return pipe between the cylinder head water jacket and the valve, in which a heat exchanger is arranged, from a supply pipe between the valve and the water jacket in which a pump is arranged, and connects a second return pipe between the combustion chamber water jacket to the valve and the by-pass pipe connected in parallel to the heat exchanger with the supply pipe. In a second operating position, the valve separates the by-pass pipeline from the cylinder head water jacket from the supply line and connects first and second return pipelines to the supply pipe.

SUMMARY

The present disclosure improves an internal combustion engine, more particularly a motor vehicle with an internal combustion engine and/or its cooling. According to one aspect of the present disclosure an internal combustion engine for a vehicle drive in a motor vehicle includes one or more housing parts, more particularly a cylinder head housing with a cylinder head water jacket, an exhaust system water jacket and a combustion chamber water jacket and a valve, which by way of a coolant inlet of the valve is flowed through or is supplied or charged or fed or has delivered liquid and/or gaseous coolant and through which a cross-section of an exhaust coolant outlet of the valve, which is flowed through or is supplied or charged or fed or has delivered (coolant from the valve or coolant inlet) through the exhaust water jacket. A cross-section of a combustion chamber coolant outlet of the valve is flowed through or is supplied or charged or fed or has delivered (coolant from the valve or coolant inlet) through the combustion chamber water jacket is adjusted or is set up for this. Through this, in one embodiment the supply of the exhaust and combustion chamber water jacket with coolant can be advantageously adjusted and so, more particularly its through flow and/or cooling effect varied.

In one embodiment the coolant inlet, the exhaust coolant outlet and/or the combustion chamber coolant outlet of the valve can (fluidically) be multi-channel in design or (each) have several through openings separated or at a distance from one another. In one embodiment the cross-section of such a multi-channel inlet/outlet, through which a fluid can, in particular does, flow is additively composed of the (individual) cross-sections of its through openings, through which a fluid can, more particularly does, flow. In this way, in one embodiment a flow can be improved and/or a pressure loss reduced.

In one embodiment the cross-section of the exhaust coolant outlet and the combustion chamber coolant outlet, through which a fluid can flow, are connected, more particularly synchronously and/or oppositely adjustable or adjusted. More particularly, in one embodiment the cross-section of the exhaust coolant outlet, through which fluid can flow, can be reduced/enlarged and at the same time the cross-section of the combustion chamber coolant outlet, through which fluid can flow, can be enlarged/reduced by the same amount or the valve can be set up or designed in this way. Additionally or alternatively, in one embodiment the cross-sections of the exhaust coolant outlet and/or the combustion chamber coolant outlet, through which fluid can flow, are continuously or steadily adjusted in an increasing or decreasing manner or the valve is set up or designed in this way. In this way, in one embodiment a flow can be improved.

In one embodiment the housing is produced in one part or in several parts of metal, more particularly primarily formed, more particularly cast.

In one embodiment the exhaust water jacket has a coolant inlet which fluidically communicates or is connected to the exhaust coolant outlet of the valve, more particularly (directly) adjoins or merges into it. In particular, the multi-channel coolant inlet of the exhaust water jacket can have several through openings at a distance from one another which adjoin at through openings of the multi-channel exhaust coolant outlet.

Additionally or alternatively, in one embodiment the combustion chamber water jacket has a coolant inlet which fluidically communicates or is connected to the combustion chamber coolant outlet of the valve, more particularly (directly) adjoins or merges into it. In particular, the multi-channel coolant inlet of the combustion chamber water jacket can have several through openings at a distance from one another which adjoin at through openings of the multi-channel combustion chamber coolant outlet.

In one embodiment the combustion chamber water jacket and/or the exhaust water jacket can be fluidically connected or communicate with the cylinder head water jacket at a distance from the valve, more particularly for removing coolant after flowing through the exhaust water jacket and/or the combustion chamber water jacket via or from the cylinder head water jacket. In particular, the cylinder head water jacket can include several through openings at a distance from each other which adjoin through openings of the combustion chamber coolant outlet, and/or several through openings at a distance from each other which adjoin through openings of the exhaust coolant outlet, so that at a distance from the valve the cylinder head water jacket is fluidically connected in a multi-channel manner to the exhaust water jacket and/or the combustion chamber water jacket.

Additionally or alternatively, in one embodiment the cylinder head water jacket has a coolant outlet at a distance from the valve for removing coolant, more particularly from the housing. Through this, in one embodiment an advantageous flow through the jackets and/or tempering of the housing can be achieved.

In one embodiment the valve has a tubular, rotary slide rotatably borne in a coolant-tight manner in a bearing that has the exhaust coolant outlet and the combustion chamber coolant outlet, wherein the cross-sections, through which a fluid can flow, of the exhaust coolant outlet and of the combustion chamber coolant outlet of the valve can be adjusted by turning the rotary slide. Through this, in one embodiment, a compact design and/or advantageous through flow and/or actuation of the valve can be provided.

In a further embodiment, the rotary slide has one or more axial sections, particularly at least essentially equidistantly spaced in its axial or longitudinal direction, which each have (precisely) one or more open circumferential sections, more particularly (control) slits or elongated holes, and connected thereto in each case a closed circumferential section, more particularly, a web, for the at least partial closing of at least one through opening of the exhaust coolant outlet and/or one through opening of the combustion chamber coolant outlet, wherein in the axial direction adjacent open circumferential sections can each be separated from each other by a web.

In one embodiment, in a first rotary position or angular position of the rotary slide, one or more through openings of the combustion chamber coolant outlet are at least partially or essentially completely in a coolant-tight manner are closed by one or more closed circumferential sections of the rotary slide, so that in a further development the combustion chamber coolant outlet in the first rotary position has a cross-section, through which a minimum of fluid can flow, more particularly a cross-section through which the flow of fluid is essentially equal to zero.

Additionally or alternatively in a second rotary position of the rotary slide the through opening(s) of the combustion chamber coolant outlet and one or more open circumferential sections of the rotary slide overlap at least partially, and more particularly more than in the first rotary position, so that in the second rotary position the combustion chamber coolant outlet has a larger cross-section through which a fluid can flow than in the first rotary position, in particular a maximum cross-section through which a fluid can flow.

Additionally or alternatively, particularly in the second rotary position or angular position of the rotary slide, one or more through openings of the exhaust coolant outlet are at least partially or essentially completely in a coolant-tight manner are closed so that in a further development the exhaust coolant outlet in this rotary position has a cross-section, through which a minimum of fluid can flow, more particularly a cross-section through which the flow of fluid is essential equal to zero.

Additionally or alternatively, particularly in the first rotary position or angular position of the rotary slide the through opening(s) of the exhaust coolant outlet and one or more open circumferential sections of the rotary slide overlap at least partially, more particularly more than in the aforementioned second rotary position, so that in this rotary position the exhaust coolant outlet has a larger cross-section through which a fluid can flow than in the aforementioned second rotary position, in particular a maximum cross-section through which a fluid can flow.

In one embodiment, in the first rotary position the same open circumferential section(s) of the rotary slide overlap(s) at least partially one or more through openings of the exhaust coolant outlet and in the second rotary position partially at least one or more through openings of the combustion chamber coolant outlet. Additionally or alternatively in the first rotary position the same closed circumferential section(s) of the rotary slide cover(s) one or more through openings of the combustion chamber coolant outlet and in the second rotary position partially at least one or more through openings of the exhaust chamber coolant outlet. Additionally or alternatively in a third rotary position the same open circumferential section(s) of the rotary slide cover(s) one or more through openings of the combustion chamber coolant outlet and partially at least one or more through openings of the exhaust chamber coolant outlet. In this way, in one embodiment an axially compact design of the rotary slide can be advantageously provided.

In one embodiment, the rotary slide has one or more axial sections, particularly at least essentially equidistantly spaced in its axial or longitudinal direction, which each have (precisely) one or more open circumferential sections, more particularly (control) slits or elongated holes, and connected thereto in each case a closed circumferential section, more particularly, a web, for the at least partial closing of at least one through opening of the coolant inlet of the valve. In the axial direction adjacent open circumferential sections can each be separated from each other by a web.

In a further development, at least one through opening of the coolant inlet of the valve is arranged in the axial direction of the rotary slide between two through openings of the exhaust coolant outlet and/or the combustion chamber coolant outlet. Additionally or alternatively in a further development, at least one through opening of the exhaust coolant inlet and/or the combustion chamber coolant outlet is arranged in the axial direction of the rotary slide between two through openings if the coolant inlet of the valve. Through this, in one embodiment an advantageous flow can be achieved.

In one embodiment the internal combustion engine has a, more particularly electrical or electrically-operated, actuator for adjusting the valve, more particularly for turning its rotary slide. In this way, in one embodiment the valve can be advantageously, more particularly at least partially automatically, adjusted. In one embodiment the actuator has an electrical motor which, in particular, can, via a gear, more particularly a toothed wheel gear, be actively connected, more particularly rotationally coupled with the valve, in particular its rotary slide. Through this, in one embodiment precise and/or compact actuation of the valve can take place.

In one embodiment in the first position of the valve, more particularly rotary position of its rotary slide, the exhaust coolant outlet of the valve has a first, maximum cross-section, through which a fluid can flow, and the combustion chamber coolant outlet of the valve has a first, minimum cross-section through which a fluid can flow, which in particular at least essentially can be equal to zero, and in the second position of the valve, more particularly rotary position of its rotary slide, the exhaust coolant outlet has a second, minimum cross-section, through which a fluid can flow, which in particular can be equal to zero, and the combustion chamber coolant outlet of the valve has a second, maximum, cross-section, through which a fluid can flow.

In a further development, in at least a third position of the valve, rotary position of its rotary slide which in a rotational direction from the first to the second (rotary) position can be arranged between the first and second (rotary) positions, the exhaust coolant outlet of the valve has a third cross-section through which a fluid can flow which is smaller than the first and larger than the second cross-section, through which a fluid can flow, of the exhaust coolant outlet, and the combustion chamber coolant outlet of the valve has a third cross-section, through which a fluid can flow, that is larger than the first and smaller than the second cross-section, through which a fluid can flow, of the combustion chamber coolant outlet.

Additionally or alternatively, in a further development, in a fourth position of the valve, more particularly rotary position of its rotary slide, which, in particular, can be arranged between the second and first (rotary) positions in the direction of rotation, the exhaust coolant outlet and the combustion chamber coolant outlet of the valve can be or are closed by the valve or its closed circumferential section(s) at least essentially completely, or in a coolant-tight manner.

In one embodiment the coolant inlet of the valve is open in the first, second, at least one third and/or fourth position. In particular, through openings of the coolant inlet of the valve and through openings of the circumferential section of the rotary slide can at least partially overlap in the first, second, at least one third and/or fourth position. Additionally or alternatively in one embodiment, the coolant inlet of the valve can be blocked or closed, more particularly in the fourth or a fifth position of the valve, more particularly rotary position of its rotary slide. In particular, in the fourth or fifth position, through openings of the coolant inlet of the valve can be or are close by close circumferential section of the rotary slide. Through this, in one embodiment an advantageous variable flow and, in particular, the aforementioned coupled adjustment can be brought about.

In one embodiment the exhaust coolant outlet and the combustion chamber coolant outlet of the valve can be at least partially (fluidically) connected or communicate with each other, more particularly adjoin each other or merge into each other, or can be (fluidically) separated or at a distance from one another.

Thus, in one embodiment a first through opening of the exhaust coolant outlet and a first through opening of the combustion chamber coolant outlet can merge into or adjoin each other, and in a multi-channel embodiment at least one further through opening of the exhaust coolant outlet and a further through opening of the combustion chamber coolant outlet can merge into or adjoin each other. In another embodiment the through openings of the combustion chamber coolant outlet and of the exhaust coolant outlet are separate or at a distance from one another.

Additionally or alternatively in one embodiment a first through opening of the coolant inlet of the combustion chamber water jacket and a first through opening of the coolant inlet of the exhaust water jacket can merge into or adjoin each other, and in a multi-channel embodiment at least one further opening of the combustion chamber water jacket and a further through opening of the coolant inlet of the exhaust water jacket can merge into or adjoin each other. Similarly, in one embodiment the coolant inlet of the combustion chamber water jacket and the coolant inlet of the exhaust water jacket, more particularly their through openings can be (fluidically) separated or at a distance from one another.

In one embodiment the valve is arranged in the housing, in a further development its bearing being integrated into the housing. Through this, in one embodiment a compact and/or stable arrangement of the valve can be achieved.

In one embodiment the cylinder head water jacket and the combustion chamber water jacket and/or the exhaust water jacket are separate from the housing.

In one embodiment the cylinder head water jacket and/or the combustion chamber water jacket and/or the exhaust water jacket are integrated into the housing, more particularly primarily formed, more particularly through casting, in particular with one or more, separately produced, more particularly, lost cores. Through this, in one embodiment a compact and/or thermally advantageous arrangement of the relevant water jacket can be achieved.

In one embodiment the cylinder head water jacket surrounds one or more cylinder heads of the internal combustion engine over the entire extent or a part thereof. Additionally or alternatively, in one embodiment the combustion chamber head water jacket surrounds one or more combustion chambers of the internal combustion engine over the entire extent or a part thereof. Additionally or alternatively, in one embodiment the exhaust manifold water jacket surrounds an exhaust manifold of the internal combustion engine at least over part of its extent. Through this, in one embodiment the cylinder head(s), the combustion chamber(s) or the exhaust can be advantageously tempered.

In one embodiment the exhaust manifold of the internal combustion engine is formed/produced integrally with the housing and more particularly primarily formed. Through this, in one embodiment a compact and/or thermally advantageous arrangement of the exhaust can be achieved.

The internal combustion engine can be a diesel or petrol internal combustion engine or a diesel or petrol engine, more particularly including a (pressure) charged internal combustion engine or compressor for compressing the air supplied to the cylinder(s), in particular a mechanical compressor, an electrical compressor or an exhaust turbocharger.

In one embodiment, for cooling of the internal combustion engine, the valve is partially or fully automatically adjusted into the first and/or second and/or at least a third and/or fourth and/or fifth position, as a function of an operating status of the internal combustion engine, more particularly a temperature of the housing, an exhaust of the internal combustion engine and/or the coolant.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
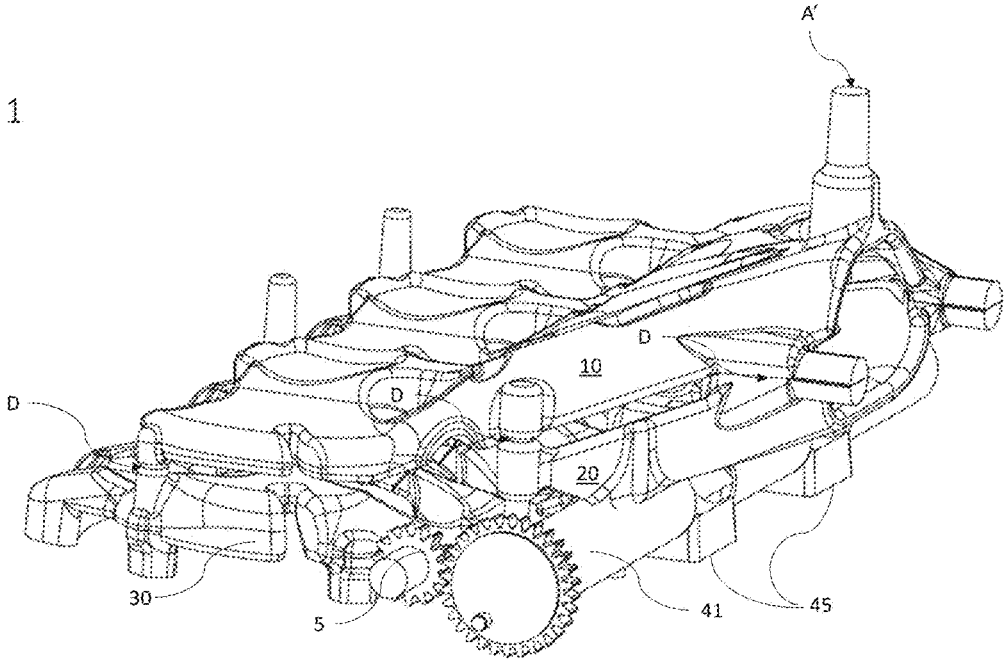
FIG. 1 shows lost cores for casting a housing with a cylinder head water jacket, an exhaust water jacket and combustion chamber water jacket as well as a rotary slide and coolant inlet of a valve of an internal combustion engine of a motor vehicle in accordance with one embodiment of the present disclosure.
Figure 3:
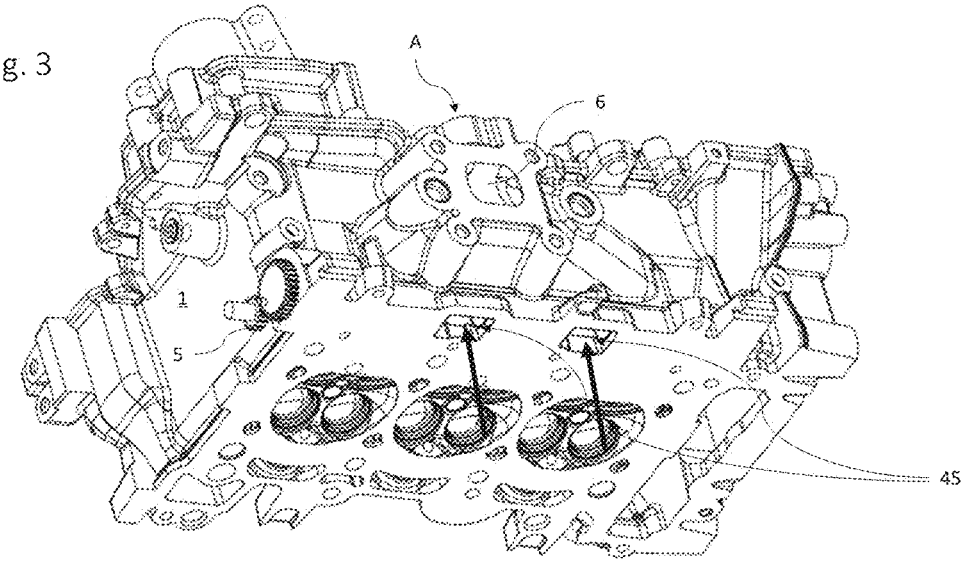
FIG. 3 shows a perspective view of the housing.

FIG. 1 shows lost cores for casting a housing 1, shown in a perspective view in FIG. 3, with a cylinder head water jacket 10 for cooling cylinder heads, an exhaust water jacket 20 for cooling an exhaust integrated in the housing 1 and a combustion chamber water jacket 30 for cooling cylinder combustion chambers as well as a rotary slide 41 and coolant inlet 45 of a valve of an internal combustion engine of a motor vehicle in accordance with one embodiment of the present disclosure.

Apart from post-processing work, more particularly at least partial removal of chaplets and the closure of the resulting external openings, the lost cores correspond with the cylinder head, exhaust or combustion chamber water jacket 10, 20 or 30 integrally formed with the housing 1, so that their formation by way of the lost cores can be shown particularly clearly and in FIG. 1 is therefore marked with the corresponding reference numbers of the water jackets.

Figure 2A:
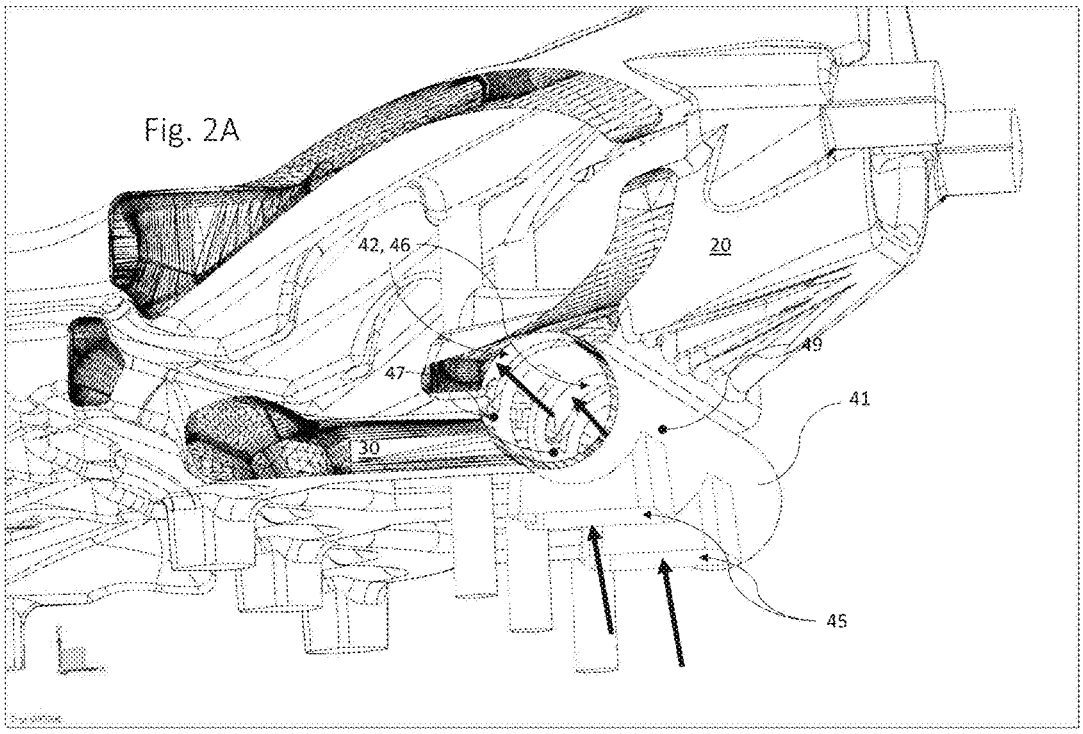
FIG. 2A shows a portion of the exhaust water jacket and the combustion chamber water jacket as well the rotary slide in a first rotary position.

Coolant flows into the valve through the multi-channel coolant inlet 45, as indicated by flow arrows in FIG. 2A.

Through the valve, more particularly adjustment of its rotary slide 41, in the manner described in more detail below with reference to FIGS. 2A-2C, a cross-section, through which a fluid can flow, of a multichannel exhaust coolant outlet 42 of the valve, through which fluid can be admitted into the exhaust water jacket 20 from the valve or its coolant inlet 45, and a cross-section, through which a fluid can flow, of a multi-channel combustion chamber coolant outlet 43 of the valve, through which fluid can be admitted to the combustion chamber water jacket 30 from the valve or its coolant inlet, can be connected and continuously adjusted, The exhaust water jacket 20 has a multi-channel coolant inlet, which or the through openings of which directly adjoin(s) the multi-channel exhaust coolant outlet 42 of the valve or its through openings. The combustion chamber water jacket 30 has a multi-channel coolant inlet, the through opening(s) of which directly adjoin(s) the combustion chamber coolant outlet 43 of the valve or its through openings, as can be seen in particular in FIG. 2A, 2C, in which, for clarification, in each case two through openings of the exhaust coolant outlet and adjoining through openings of the coolant inlet of the exhaust water jacket 20 are jointly designated 42 (see FIG. 2A) and two through openings of the combustion chamber coolant outlet and adjoining through openings of the coolant inlet of the combustion chamber water jacket 30 are jointly designated 43 (see FIG. 2C).

At a distance from the valve, the combustion chamber water jacket 30 and the exhaust water jacket 20 are fluidically connected in a multi-channel manner via through openings, of which several are indicated by D in FIG. 1, to the cylinder head water jacket 10 for removing coolant, after flowing through the exhaust water jacket 20 and to the combustion chamber water jacket 30, via the or from the cylinder head water jacket 10.

Additionally, the cylinder head water jacket 10 has a coolant outlet A at a distance from the valve for removing coolant, more particularly from the housing, which is produced by drilling open the chaplet designated A in FIG. 1.

Figure 2B:
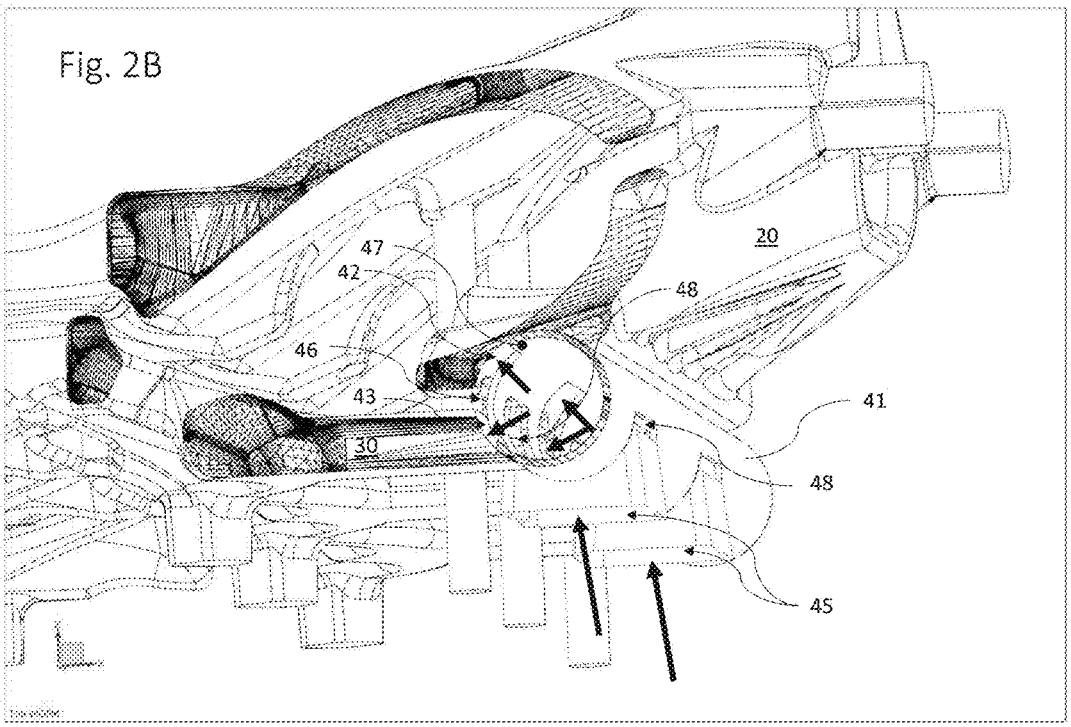
FIG. 2B is similar to FIG. 2A showing the rotary slide in a third rotary position.
Figure 2C:
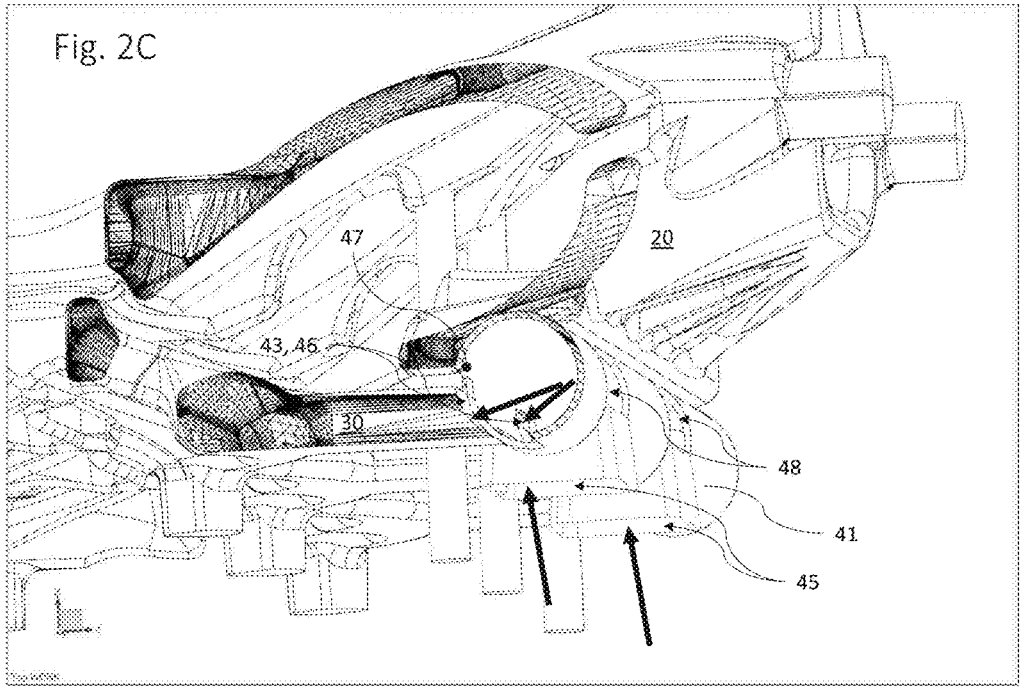
FIG. 2C is similar to FIGS. 2A and 2B showing the rotary slide in a second rotary position.

As can be seen in FIGS. 2A-2C in particular, the valve includes the tubular rotary slide 41 which is rotationally borne in the bearing formed integrally with the housing and includes the multi-channel exhaust coolant outlet 42 and the multi-channel combustion chamber coolant outlet 43, wherein the cross-sections, through which a fluid can flow, of the exhaust coolant outlet 42 and of the combustion chamber coolant outlet 43 can be adjusted by turning the rotary slide 41.

In its axial direction the rotary slide 41 has several axial sections at a distance from one another which each have an open circumferential section in the form of a control slit or elongated hole 46 and an adjoining closed circumferential section in the form of a web 47 each for closing a through opening of the exhaust coolant outlet 42 and of the combustion chamber coolant outlet 43, wherein adjacent open circumferential sections 46 in the axial direction are each separated from one another by a web.

In a first rotary position of the rotary slide 41 shown in FIG. 2A the through openings of the combustion chamber coolant outlet 43 can be or are at least essentially, completely closed by closed circumferential sections 47 of the rotary slide 41 so that the combustion chamber coolant outlet 43 in the first rotary position has a cross-section, through which a minimum of fluid can flow, which is essentially equal to zero.

In a second rotary position FIG. 2C the through openings of the combustion chamber coolant outlet 43 and the open circumferential sections 46 of the rotary slide 41 overlap each other so that in the second rotary position the cross-section of the combustion chamber coolant outlet 43 is the maximum through which a fluid can flow. This is shown in FIG. 2C in that the through openings of the combustion chamber coolant outlet 43 and the open circumferential sections 46 of the rotary slide 41 have the same reference arrows.

Contrary thereto, in the second rotary position of the rotary slide 41 the through openings of the exhaust coolant outlet 42 are at least essentially, completely closed by the same closed circumferential sections 47 of the rotary slide 41 so that the exhaust coolant outlet 42 in this second rotary position has a cross-section, through which a minimum of fluid can flow, which is essentially equal to zero.

Accordingly, in the first rotary position the through openings of the exhaust coolant outlet 42 and the same open circumferential sections 46 of the rotary slide 41 overlap each other so that in this first rotary position the cross-section of the exhaust coolant outlet 42 is the maximum through which a fluid can flow. This is shown in FIG. 2A in that the through openings of the exhaust coolant outlet 42 and the open circumferential sections 46 of the rotary slide 41 have the same reference arrows.

Thus, in the first rotary position, the same open circumferential sections 46 of the rotary slide 41 overlap the through openings of the exhaust coolant outlet 42, and in the second rotary position the through openings of the combustion chamber coolant outlet 43, in the first position the same closed circumferential sections 47 of the rotary slide 41 close the through openings of the combustion chamber coolant outlet 43 and in the second rotary position the through openings of the exhaust coolant outlet 42.

In a third rotary position shown in FIG. 2B, the same open circumferential sections 46 of the rotary slide 41 partially cover the through openings of the combustion chamber coolant outlet 42 and the through openings of the exhaust coolant outlet 43, so that the exhaust coolant outlet 42 has a third cross-section through which a fluid can flow which is smaller than the first and larger than the second cross-section, through which a fluid can flow, of the exhaust coolant outlet, and the combustion chamber coolant outlet 43 of the valve has a third cross-section, through which a fluid can flow, that is larger than the first and smaller than the second cross-section, through which a fluid can flow, of the combustion chamber coolant outlet 43.

Additionally, in a fourth rotary position, which is not shown, of the rotary slide 41, which in a direction of rotation from the first via the third to the second rotary position follows on from the second rotary position in FIG. 2C, both the exhaust coolant outlet 42 and the combustion chamber coolant outlet 43 of the valve can be or are at least essentially fully closed by the same closed circumferential sections 47.

Similarly, in its axial direction the rotary slide 41 has several axial sections at a distance from one another which each have an open circumferential section in the form of a control slit or elongated hole 48 and an adjoining closed circumferential section in the form of a web 49 each for closing a through opening of the coolant inlet 45 of the valve, wherein adjacent open circumferential sections 48 in the axial direction are each separated from one another by a web.

Here the through openings of the coolant inlet 45 of the valve are arranged in the axial direction of the rotary slide 41 between two through openings of the exhaust coolant outlet 42 and the combustion chamber coolant outlet 43. In the first, second and third rotary position, as can be seen in FIGS. 2A-2C, the coolant inlet 45 of the valve is open. On the other hand, in the fourth rotary position of the rotary slide 41 the coolant inlet 45 of the valve is also closed by the closed circumferential sections 49.

The internal combustion engine has as electrical actuator for adjusting the rotary slide 41 with an electric motor (not shown), which via a toothed wheel 5 of the actuator is rotationally connected to the rotary slide 41.

The cylinder head water jacket 10, the combustion chamber water jacket 30 and the exhaust water jacket 20 are integrally primarily formed with the housing through casting with the several separately produced lost cores shown in FIG. 1.

For cooling the internal combustion engine, through the actuator the rotary slide 41 of the valve is at least partially automatically adjusted, more particularly alternately into the aforementioned first, second, third or fourth position as a function of an operating status of the internal combustion engine, more particularly a temperature of the housing, an exhaust of the internal combustion engine and/or the coolant.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. An internal combustion engine for a motor vehicle drive comprising:

a housing having a cylinder head water jacket, an exhaust water jacket and a combustion chamber water jacket; and a valve configured to selectively admit a coolant flow through a multi-channel coolant inlet by adjusting a cross section through which coolant can flow to a multi-channel exhaust coolant outlet for admitting the coolant flow to the exhaust water jacket and through which coolant can flow to a multi-channel combustion chamber coolant outlet for admitting a flow to the combustion chamber water jacket.

2. The internal combustion engine according to claim 1, wherein the cylinder head water jacket is fluidically connected in a multi-channel manner to at least one of the exhaust water jacket or the combustion chamber water jacket at a distance from the valve and has a coolant outlet at a distance from the valve for removing coolant.

3. The internal combustion engine according to claim 1, wherein the valve comprises a rotary slide rotatably supported on a bearing for adjusting the cross section of the exhaust coolant outlet and the combustion chamber coolant outlet, wherein the cross-sections by turning the rotary slide.

4. The internal combustion engine according to claim 3, wherein the bearing is integrally formed with the housing and the valve is arranged therein.

5. The internal combustion engine according to claim 3, wherein the rotary slide comprises at least two axial sections at a distance from one another, each section having an open circumferential section and an adjoining closed circumferential section for at least partially closing at least one of an exhaust through opening of the exhaust coolant outlet or a combustion chamber through opening of the combustion chamber coolant outlet.

6. The internal combustion engine according to claim 3 wherein the rotary slide comprises at least two axial sections at a distance from one another, each axial section having an open circumferential section and an adjoining closed circumferential section for the at least partial closing of at least one through opening of the coolant inlet of the valve.

7. The internal combustion engine according to claim 1 further comprising an actuator for adjusting the valve.

8. The internal combustion engine according to claim 1, wherein the valve is positionable between a first valve position such that the exhaust coolant outlet has a maximum cross-section and the combustion chamber coolant outlet of the valve has a minimum cross-section which coolant can flow, and a second position such that the exhaust coolant outlet has a minimum cross-section and the combustion chamber coolant outlet has a maximum cross-section through which coolant can flow.

9. The internal combustion engine according to claim 8, wherein the valve is positionable in a third position such that the exhaust coolant outlet an intermediate cross-section which is smaller than the maximum and larger than the minimum cross section of the exhaust coolant outlet, and the combustion chamber coolant outlet has an intermediate cross-section that is larger than the minimum and smaller than the maximum cross of the combustion chamber coolant outlet.

10. The internal combustion engine according to claim 9, wherein a coolant inlet of the valve is open in the first, second, and third positions and closed in a fourth position of the valve.

11. The internal combustion engine according to claim 1, wherein at least one of the cylinder head water jacket, the exhaust water jacket and the combustion chamber water jacket is formed integrally with the housing.

12. The internal combustion engine according to claim 11 wherein at least two water jackets are formed integrally with the housing.

13. The internal combustion engine according to claim 1, wherein at least one of the cylinder head water jacket, the exhaust water jacket and the combustion chamber water jacket is formed separately from the housing.

14. The internal combustion engine according to claim 1, wherein the cylinder head water jacket surrounds at least one cylinder head of the internal combustion engine over at least part of its extent and the combustion chamber water jacket surrounds at least one combustion chamber of the internal combustion engine over at least part of its extent, and the exhaust water jacket surrounds an exhaust manifold of the internal combustion engine over a part of its extent.

15. The internal combustion engine according to claim 14, wherein the exhaust manifold is integrated with the housing.

16. The internal combustion engine according to claim 1, wherein the internal combustion engine is a charged Diesel engine or is a charged petrol engine.

17. A motor vehicle comprising an internal combustion engine according to claim 1.

18. A method of cooling an internal combustion engine having a housing having a cylinder head water jacket, an exhaust water jacket and a combustion chamber water jacket, and a valve configured to selectively admit a coolant flow through a multi-channel coolant inlet by adjusting a cross section through which coolant can flow to a multi-channel exhaust coolant outlet for admitting the coolant flow to the exhaust water jacket and through which coolant can flow to a multi-channel combustion chamber coolant outlet for admitting a flow to the combustion chamber water jacket, the method comprising at least partially automatically adjusting the valve as a function of an operating temperature of the internal combustion engine.

19. The method according to claim 18, where in the operating temperature is selected from the group consisting of a temperature of the housing, a temperature of an exhaust of the internal combustion engine, a temperature of the coolant or a combination thereof.

20. An internal combustion engine for a motor vehicle drive comprising:

a housing having a cylinder head water jacket, an exhaust water jacket and a combustion chamber water jacket; and a valve configured to selectively admit a coolant flow through a multi-channel coolant inlet by adjusting a cross section through which coolant can flow to a multi-channel exhaust coolant outlet for admitting the coolant flow to the exhaust water jacket and through which coolant can flow to a multi-channel combustion chamber coolant outlet for admitting a flow to the combustion chamber water jacket, wherein the valve comprises a rotary slide rotatably supported on a bearing for adjusting the cross section of the exhaust coolant outlet and the combustion chamber coolant outlet, wherein the cross-sections by turning the rotary slide and wherein the valve is positionable such that open sections of the rotary slide partially covers through openings of the combustion chamber coolant outlet and through openings of the exhaust coolant outlet so that fluid can flow through the exhaust coolant outlet and the combustion chamber coolant outlet.

* * * * *